US012590493B2

(12) United States Patent
Zhang et al.

(10) Patent No.: US 12,590,493 B2
(45) Date of Patent: Mar. 31, 2026

(54) HIGH PRESSURE WATER JET AUTOMATIC DRILLING AND CUTTING COLLABORATIVE SYSTEM AND METHOD FOR COAL SEAMS

(71) Applicant: CCTEG ChongQing Research Institute Co., Ltd., ChongQing (CN)

(72) Inventors: Yongjiang Zhang, ChongQing (CN); Lindong Guo, ChongQing (CN); Xusheng Zhao, ChongQing (CN); Zhenfei Huang, ChongQing (CN); Junjian Xu, ChongQing (CN); Shuai Li, ChongQing (CN); Wenbin Wu, ChongQing (CN); Zhanjin Lu, ChongQing (CN); Fei Ji, ChongQing (CN); Chengcheng Li, ChongQing (CN); Yongsan Liu, ChongQing (CN); Liangwei Li, ChongQing (CN); Fengyuan Qin, ChongQing (CN); Runzhe Zhang, ChongQing (CN)

(73) Assignee: CCTEG Chongqing Research Institute Co., Ltd., Chongqing (CN)

( * ) Notice: Subject to any disclaimer, the term of this patent is extended or adjusted under 35 U.S.C. 154(b) by 0 days.

(21) Appl. No.: 18/875,183

(22) PCT Filed: Dec. 7, 2023

(86) PCT No.: PCT/CN2023/137031

§ 371 (c)(1),
(2) Date: May 5, 2025

(87) PCT Pub. No.: WO2025/107363

PCT Pub. Date: May 30, 2025

(65) Prior Publication Data

US 2026/0055666 A1 Feb. 26, 2026

(30) Foreign Application Priority Data

Nov. 24, 2023 (CN) ..... 202311585855.0

(51) Int. Cl.
*E21B 7/18* (2006.01)
*E21B 44/00* (2006.01)
*E21C 25/60* (2006.01)

(52) U.S. Cl.
CPC ..... *E21B 7/18* (2013.01); *E21B 44/00* (2013.01)

(58) Field of Classification Search
CPC . E21B 7/18; E21B 43/29; E21C 41/18; E21C 45/02; E21C 25/04; E21C 25/60
(Continued)

(56) References Cited

U.S. PATENT DOCUMENTS 4,079,999 A * 3/1978 Grimley ..... E21C 25/60 299/17
4,226,475 A * 10/1980 Frosch ..... E21C 25/60 299/20

(Continued)

FOREIGN PATENT DOCUMENTS

CN 104563990 A 4/2015
CN 110145233 A 8/2019

(Continued)

OTHER PUBLICATIONS

International Search Report of PCT/CN2023/137031, published on Mar. 20, 2024.

(Continued)

*Primary Examiner* — Kenneth L Thompson
(74) *Attorney, Agent, or Firm* — Wang Law Firm, Inc.

(57) ABSTRACT

The present invention relates to a high pressure water jet automatic drilling and cutting collaborative system and
(Continued)

method for coal seams, and belongs to the field of coal seam gas control. The system comprises a drilling and cutting collaborative control platform, an automatically regulated slotting pump unit and an automatically regulated drill; the drilling and cutting collaborative control platform comprises a coalbed gas geology management system, a decision analysis system, a drilling and cutting collaborative execution system, a monitoring and feedback system, and an information management and evaluation system; construction operation parameter instructions issued by the drilling and cutting collaborative control platform are executed by the automatically regulated slotting pump unit and the automatically regulated drill; coal seam geological information is recorded by the coalbed gas geology management system, and reasonable drilling and cutting construction parameters are analyzed and formulated by the decision analysis system based on the coal seam geological information. Drilling and cutting collaborative construction, on-site operation construction parameter monitoring, and real-time feedback and adjustment are realized by the drilling and cutting collaborative execution system and the monitoring feedback system according to the operation parameter instructions. Coal seam outburst prevention and control effects in a drilling and cutting collaborative implementation area is evaluated by the information management and evaluation system. The present invention improves safety of on-site operators, and reduces personnel input and labor intensity.

10 Claims, 6 Drawing Sheets

(58) Field of Classification Search
USPC ..... 299/17, 10
See application file for complete search history.

(56) References Cited

U.S. PATENT DOCUMENTS

| | | | | | |
|---|---|---|---|---|---|
| 4,708,395 | A * | 11/1987 | Petry | E21C 45/00 | 299/30 |
| 5,879,057 | A * | 3/1999 | Schwoebel | E21B 43/292 | 299/56 |
| 9,273,553 | B2 * | 3/2016 | Gray | E21B 43/26 | |
| 11,143,025 | B2 * | 10/2021 | Zhang | E21C 41/18 | |
| 12,098,638 | B1 * | 9/2024 | Feng | E21C 41/18 | |
| 12,168,932 | B2 * | 12/2024 | Wang | E21F 7/00 | |
| 12,221,887 | B2 * | 2/2025 | Wang | E21D 20/02 | |
| 2018/0209255 | A1 | 7/2018 | Lin et al. | | |
| 2022/0213773 | A1 | 7/2022 | Wang et al. | | |

FOREIGN PATENT DOCUMENTS

| | | | |
|---|---|---|---|
| CN | 113153417 | A | 7/2021 |
| CN | 113756711 | A | 12/2021 |
| CN | 116557042 | A | 8/2023 |

OTHER PUBLICATIONS

Written Opinion of PCT/CN2023/137031, published on Mar. 20, 2024.
The claims of PCT/CN2023/137031.

* cited by examiner

HIGH PRESSURE WATER JET AUTOMATIC DRILLING AND CUTTING COLLABORATIVE SYSTEM AND METHOD FOR COAL SEAMS

FIELD OF INVENTION

The present invention belongs to the field of coal seam gas control, and relates to a high pressure water jet automatic drilling and cutting collaborative system and method for coal seams.

BACKGROUND ART OF THE INVENTION

With the development of coal mine disaster prevention technology and equipment, hydraulic measures have become one of the main technical means for coal seam pressure relief and permeability improvement. Among which, high pressure water jet, as a measure for coal seam pressure relief and permeability improvement, has been widely promoted and applied in mines because of the technical advantages of precise, controllable and uniform pressure relief and permeability improvement. However, due to complicated geological conditions of coal and gas occurrence, especially in high-stress tectonic belts, high pressure water jet construction is difficult, and phenomena such as hole caving, hole plugging and drill burying are easy to occur. In addition, on-site construction is mostly judged according to experience of on-site personnel, and selection of construction parameters is somewhat blind, which often leads to uneven coal seam pressure relief and permeability improvement, and low on-site construction efficiency. Therefore, effect of coal seam pressure relief and permeability improvement is poor, which seriously restricts coal seam gas extraction and increases cycles of gas treatment.

In recent years, with intelligent upgrading of coal industry, "less manned and unmanned operations" has been gradually realized. Remarkable progress has been made in gas geological analysis and intelligent development of monitoring in high gassy and outburst mines. However, on-site implementation of two-level "four-in-one" outburst prevention measures in coal mines still relies on traditional construction methods, and development of automated and intelligent operation of technical equipment lags behind. As high pressure water jet technology and equipment are main coal mine gas disaster prevention means, it is urgent to develop a high pressure water jet automatic drilling and cutting collaborative system and method for coal seams, thus to improve drilling and slotting construction automation level, and improve the effect of coal seam pressure relief and permeability improvement and the construction efficiency. At the same time, the collaborative system and method can improve safety of on-site operators, and reduce personnel input and labor intensity.

DISCLOSURE OF THE INVENTION

In view of this, the purpose of the present invention is to provide a high pressure water jet automatic drilling and cutting collaborative system and method for coal seams, thus to realize automated operation of drilling and slotting construction by high pressure water jet, realize drilling and cutting collaborative operation and autonomous control, improve the effect of coal seam pressure relief and permeability improvement and the construction efficiency, reduce personnel input, and improve safety of on-site operators.

To achieve the above purpose, the present invention provides the following technical solution:

A high pressure water jet automatic drilling and cutting collaborative system for coal seams, which comprises a drilling and cutting collaborative control platform 1, an automatically regulated slotting pump unit 2 and an automatically regulated drill 3;

The drilling and cutting collaborative control platform 1 comprises a coalbed gas geology management system, a decision analysis system, a drilling and cutting collaborative execution system, a monitoring and feedback system, and an information management and evaluation system;

Construction operation parameter instructions issued by the drilling and cutting collaborative control platform are executed by the automatically regulated slotting pump unit and the automatically regulated drill;

Coal seam geological information is recorded by the coalbed gas geology management system, and coal seam type and outburst prevention measures are analyzed and judged by the decision analysis system based on the coal seam geological information;

A construction operation command is sent to the drilling and cutting collaborative execution system by the decision analysis system to control the automatically regulated drill 3 to start drilling and control the automatically regulated slotting pump unit 2 to start slotting; reasonable drilling and cutting construction parameters of drilling spacing, drilling depth, slotting process and slotting radius are analyzed and determined by the decision analysis system based on coal seam basic parameter information provided by the coalbed gas geology management system;

The drilling and cutting collaborative execution system is monitored by the monitoring feedback system to control operation parameter instructions and device performance indexes during drilling and slotting construction executed by the automatically regulated drill 3 and the automatically regulated slotting pump unit 2;

Monitored parameters of drilling and slotting are sent to the information management and evaluation system by the monitoring feedback system;

Slotting parameter feedback is sent to the automatically regulated slotting pump unit, drill parameter feedback is sent to the automatically regulated drill and the drilling and cutting collaborative execution system, and drilling and slotting parameter feedback is sent to the decision analysis system by the monitoring feedback system; slotting parameters are formulated and a slotting construction operation command is sent by the decision analysis system according to construction data;

The high pressure water jet automatic drilling and cutting collaborative system for coal seams also comprises roadway positioning sensors 4 and a wireless positioning slotting device 12, and the roadway positioning sensors 4 are arranged within a certain range of a roadway construction site;

The automatically regulated slotting pump unit 2 is provided with a pump unit positioning receiver 2-1;

The automatically regulated drill 3 is provided with a drill positioning receiver 3-1;

The wireless positioning slotting device 12 is used for receiving a slotting positioning signal;

A certain distance is maintained among the roadway positioning sensors 4, the wireless positioning slotting device 12, the pump unit positioning receiver 2-1 and the drill positioning receiver 3-1, a signal is transmitted wirelessly to the automatic drilling and cutting collaborative system, and the system is automatically moved to a next construction site for construction according to a borehole construction spacing;

A scalar quantity of gas extraction in the borehole within one month after completion of borehole drilling and cutting construction in all units is counted, and effective extraction radius of boreholes, coal seam gas extraction rate and coal seam extraction standard evaluation are analyzed by the information management and evaluation system to evaluate gas control effect in the units.

Optionally, the coal seam geological information includes width of a working face of a coal seam, stratum type of coal seam roof, stratum type of coal seam floor, roof and floor stability, coal seam thickness, coal seam inclination angle, fault structure position in the coal seam, coal body failure type, coal body firmness coefficient, gas pressure and gas content.

Optionally, the parameters of slotting process and slotting radius are determined by the decision analysis system according to the coal seam thickness, the coal body failure type, the coal body firmness coefficient, and coal rock condition while drilling;

When the coal body failure type is Type IV, ring cutting process is selected as the slotting process;

When the coal body failure type is Type I, II, III or coal seam tectonic region, flat cutting process is selected as the slotting process;

When the coal seam thickness is 0-3 m, the slotting radius is 1 m;

When the coal seam thickness is 3-6 m, the slotting radius is 2 m;

When the coal seam thickness is ≥6 m, the slotting radius is 2 m, and double rows of slotting boreholes are arranged;

When the coal body firmness coefficient is $f \leq 0.5$, the slotting radius is 2.5 m;

When the coal body firmness coefficient is $0.5 \leq f \leq 1$, the slotting radius is 2 m;

When the coal body firmness coefficient is $f \geq 1$, the slotting radius is 1 m;

The ring cutting process is selected as the slotting process in a crushing area of a coal hole section, and the flat cutting process is selected as the slotting process in a complete area of the coal hole section.

Optionally, if the fault structure position in the coal seam is Z, an area within 100 m of the fault structure position Z is defined as one outburst prevention and extraction standard evaluation unit.

Optionally, when the working face of the coal seam is 600 m long and 200 m wide, the stratum type of coal seam roof and the stratum type of coal seam floor are packsand, the roof and floor stability is stable, the coal seam thickness is 5 m, the coal seam inclination angle is 2°, the fault structure position in the coal seam is that a fault structure is found at a position of 300 m, the coal body failure type is type II, the coal body firmness coefficient f is 0.5, the gas pressure is 0.9 MPa, and the gas content is 12 $m^3/t$, The coal seam is divided into three outburst prevention and extraction standard evaluation units, 0 m-200 m is a first unit, 200 m-400 m is a second unit, and 400 m-600 m is a third unit;

Flat cutting boreholes 10 are implemented in the first and the third units, and ring cutting and flat cutting cross boreholes 9 and flat cutting boreholes 10 are implemented in the second unit for gas extraction boreholes;

According to the construction parameters that the drilling spacing is 5 m and the drilling depth is 100 m, a rotational speed is set to be 80 r/min and an advance speed is set to be 3 min/m.

Optionally, the automatically regulated drill 3 is controlled by the drilling and cutting collaborative execution system to start a borehole drilling construction operation and construct the ring cutting and flat cutting cross boreholes 9 in a tectonic belt region of the second unit;

The data of drill construction footage, drill pipe rotation speed and drill torque of the automatically regulated drill 3 is monitored by the monitoring feedback system to transmit the data to the coalbed gas geology management system in real time and record the data;

During construction of the ring cutting and flat cutting cross boreholes 9, within 0-40 m and 60-80 m of the coal hole section, a drill pipe advance speed is normal and coal dust discharge is uniform, and it is monitored that the drill has a rotational speed of 80 r/min, an advance speed of 3 m/min, and a torque of 3000 N m; within 40-60 m and 80-100 m, coal body is crushed, the drill has a rotational speed of 100 r/min, an advance speed of 3.5 m/min, and a torque of 2500 N m, which are within the ranges of construction parameters, and construction data is recorded and uploaded to the coalbed gas geology management system;

Starting from a bottom of a borehole, ring cutting slots 9-1 are constructed within 80-100 m and 40-60 m, and flat cutting slots 9-2 are constructed within 60-80 m and 20-40 m;

The slotting radius is 1-1.5 m, and the slotting pressure is 80-100 MPa; during slotting construction, the ring cutting speed is set to be 60 r/min, the pressure is set to be 80-100 MPa, and the torque is set to be 5000 N m; during flat cutting, a drill pipe pullback speed is 10 min/m, and the pressure is 80-100 MPa;

In the ring cutting and flat cutting cross boreholes 9 or the flat cutting boreholes and the ring cutting and flat cutting cross boreholes, a spacing between the ring cutting slots 9-1 is 2-3 times the slotting radius, a spacing between the flat cutting slots 9-2 is 3-5 times the slotting depth, and a spacing between the ring cutting slots and the flat cutting slots is 3 times the slotting depth;

Drill pipe withdrawal type slotting is adopted from the bottom of the borehole and is collaboratively controlled by the automatically regulated slotting pump unit 2 and the automatically regulated drill 3 according to the slotting parameters; the ring cutting slots 9-1 are constructed within 40-60 m and 80-100 m of the coal hole section for 7 cuttings, respectively, and the flat cutting slots 9-2 are constructed within 60-80 m and 20-40 m of the coal hole section for 4 cuttings, respectively;

When slotting construction is executed, it is monitored that the slotting pressure is 80-100 MPa, the flow rate is 110-130 L/min, slotting time of a single cutting is 10-15 min, oil temperature of the automatically regulated slotting pump unit 2 is 40°-50°, and water level should ensure that more than ⅔ of construction operation parameters are within normal ranges;

During slotting construction, it is monitored that the drill pipe rotational speed of the automatically regulated drill 3 during ring cutting is 60 r/min, the drill torque is less than or equal to 5000 N m, and the drill pipe pullback speed during flat cutting is 10 min/m;

It is monitored that a nozzle angle deviation of the flat cutting slots 9-2 during construction is ≤±10°, which is within a normal range of the deviation;

After construction of the ring cutting and flat cutting cross boreholes 9 is completed, the automatically regulated slotting pump unit 2 and the automatically regulated drill 3 are controlled to move successively to the flat cutting boreholes 10 according to the roadway positioning sensors, spacing between the flat cutting slots is 5 m, slotting range of the coal hole section is 20-100 m, and slotting is conducted for 15 cuttings; the above steps are repeated to complete the flat cutting boreholes 10 and flat cutting construction boreholes 11; similarly, flat cutting borehole construction in the first unit and the third unit is completed.

Optionally, equipment operation parameters as well as drilling and cutting construction parameters of the automatically regulated slotting pump unit 2 and the automatically regulated drill 3 are monitored by the monitoring feedback system;

The parameters specifically include drill construction footage, drill pipe rotational speed and drill torque, and data of the parameters are transmiltted to the coalbed gas geology management system in real time; different drill pipe rotational speeds are set for borehole construction or ring cutting construction according to coal seams of different geological conditions; during drilling and cutting, when monitored parameters of the drill pipe rotational speed and the torque deviate from set parameters by 30%, the data is fed back to the decision analysis system and the drilling and cutting collaborative execution system to control the automatically regulated drill, the automatically regulated drill 3 is controlled to reduce the rotational speed by 50%, and the slotting pump unit is controlled to reduce the slotting pressure to 0;

When flat cutting slots are constructed for a borehole, a slotting angle is monitored by the wireless positioning slotting device; when an angular deviation is +15°, the slotting angle is corrected to 0°;

Parameters of borehole slag discharge amount, slag discharge slurry concentration and gas concentration during drilling and cutting construction are monitored, and critical parameters of the slag discharge amount are given according to coal seams of different geological conditions; when it is monitored that the borehole slag discharge amount is greater than 10% of a set critical value, the automatically regulated drill 3 is controlled to reduce the rotational speed by 50%, and the automatically regulated slotting pump unit 2 is controlled to reduce the slotting pressure to 50 MPa; when the slag discharge slurry concentration is greater than 50% during slotting, the automatically regulated slotting pump unit 2 is stopped, and drill pipe withdrawal is conducted by the automatically regulated drill 3 to move to a next slotting position;

It is monitored that during borehole construction, when the ring cutting slots 9-1 are constructed, if the borehole slag discharge amount is 0.8-1.0 t, the slag discharge slurry concentration is 20%-30%; if the borehole slag discharge amount is 1-1.5 t, the slag discharge slurry concentration is 30%-35%; during slotting implementation, it is monitored that emitted gas concentration within a construction range is ≤0.5%; according to the positions and number of the ring cutting slots 9-1 and the flat cutting slots 9-2 designed in the boreholes, drill pipe withdrawal is conducted successively to complete the slotting borehole construction.

Optionally, the effective extraction radius of boreholes is greater than ½ of the drilling spacing, otherwise it is determined that a gas extraction blank zone exists in the coal seam;

In an extraction period, gas extraction concentration of a single gas extraction borehole is not less than 30%, otherwise it is determined that the borehole has a gas leakage and poor sealing, and the borehole needs to be re-sealed; by measuring residual gas content of the coal seam and inputting the gas pressure into the information management and evaluation system to prevent sudden evaluation, the standard is stipulated to be that the residual gas content of the coal seam is 6 $m^3/t$ and the gas pressure is below 0.6 MPa; if standard values are exceeded, extraction time is extended for half a month until measured values are below the standard values.

A high pressure water jet automatic drilling and cutting collaborative method for coal seams, which comprises the following steps:

Executing construction operation parameter instructions issued by the drilling and cutting collaborative control platform by the automatically regulated slotting pump unit and the automatically regulated drill;

Recording coal seam geological information by the coalbed gas geology management system, and analyzing and judging coal seam type and outburst prevention measures by the decision analysis system based on the coal seam geological information;

A construction operation command is sent to the drilling and cutting collaborative execution system by the decision analysis system to control the automatically regulated slotting pump unit 2 to start slotting and control the automatically regulated drill 3 to start drilling; analyzing and determining reasonable drilling and cutting construction parameters of drilling spacing, drilling depth, slotting process and slotting radius by the decision analysis system based on coal seam basic parameter information provided by the coalbed gas geology management system;

Sending drilling and slotting operation parameter instructions to the monitoring feedback system by the drilling and cutting collaborative execution system;

Sending monitored parameters of drilling and slotting to the information management and evaluation system by the monitoring feedback system;

Sending slotting parameter feedback to the automatically regulated slotting pump unit, sending drill parameter feedback to the automatically regulated drill and the drilling and cutting collaborative execution system, and sending drilling and slotting parameter feedback to the decision analysis system by the monitoring feedback system;

The high pressure water jet automatic drilling and cutting collaborative system for coal seams also comprises roadway positioning sensors 4 and a wireless positioning slotting device 12, and the roadway positioning sensors 4 are arranged within a certain range of a roadway construction site;

The automatically regulated slotting pump unit 2 is provided with a pump unit positioning receiver 2-1;

The automatically regulated drill 3 is provided with a drill positioning receiver 3-1;

The wireless positioning slotting device 12 is used for receiving a slotting positioning signal;

A certain distance is maintained among the roadway positioning sensors 4, the wireless positioning slotting device 12, the pump unit positioning receiver 2-1 and the drill positioning receiver 3-1, a signal is transmitted wirelessly to the automatic drilling and cutting collaborative system, and the system is automatically moved to a next construction site for construction according to a borehole construction spacing;

The slotting pressure, the flow rate, slotting operation time, the oil temperature and the water level during the operation of the automatically regulated slotting pump unit 2, the drill pipe rotational speed and the drill torque of the automatically regulated drill 3, as well as the borehole slag discharge amount, the slag discharge slurry concentration and the gas concentration during borehole drilling and cutting construction are monitored by the monitoring feedback system;

After borehole construction of the second unit is completed, the automatically regulated slotting pump unit and the automatically regulated drill are controlled to move successively to a next borehole according to the roadway positioning sensors, and the above steps are repeated to successively complete drilling in the first unit and the third unit.

Optionally, a scalar quantity of gas extraction in the borehole within one month after completion of borehole drilling and cutting construction in all units is counted, and effective extraction radius of boreholes, coal seam gas extraction rate and coal seam extraction standard evaluation are analyzed by the information management and evaluation system to evaluate gas control effect in the units;

Effective extraction radius of slotting boreholes is greater than ½ of the drilling spacing, otherwise it is determined that a gas extraction blank zone exists in the coal seam; in an extraction period, gas extraction concentration of a single construction shall not be less than 30%, otherwise it is determined that the borehole has a gas leakage and poor sealing, and the borehole is re-sealed; by measuring residual gas content of the coal seam and inputting the gas pressure into the information management and evaluation system to prevent sudden evaluation, the standard is stipulated to be that the residual gas content of the coal seam is 6 $m^3/t$ and the gas pressure is below 0.6 MPa; if standard values are exceeded, extraction time is extended for half a month until measured values are below the standard values.

The present invention has the following beneficial effects: through innovative invention of the drilling and cutting collaborative control platform, the automatically regulated slotting pump unit and the automatically regulated drill, the present invention changes the present situation that traditional drilling and slotting are independent constructions and are operated relying on on-site construction experience, has the functions of geology management, decision analysis, monitoring feedback, collaborative control, etc., realizes automated collaborative operation and autonomous control of drilling and high pressure water jet slotting construction, and improves the effect of coal seam pressure relief and permeability improvement and the construction efficiency. At the same time, the present invention can improve safety of on-site operators and reduce personnel input and labor intensity, and has a high on-site promotion value.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF THE DRAWINGS

To enable the purpose, the technical solution and the advantages of the present invention to be more clear, the present invention will be preferably described in detail below in combination with the drawings, wherein.

Figure 1:
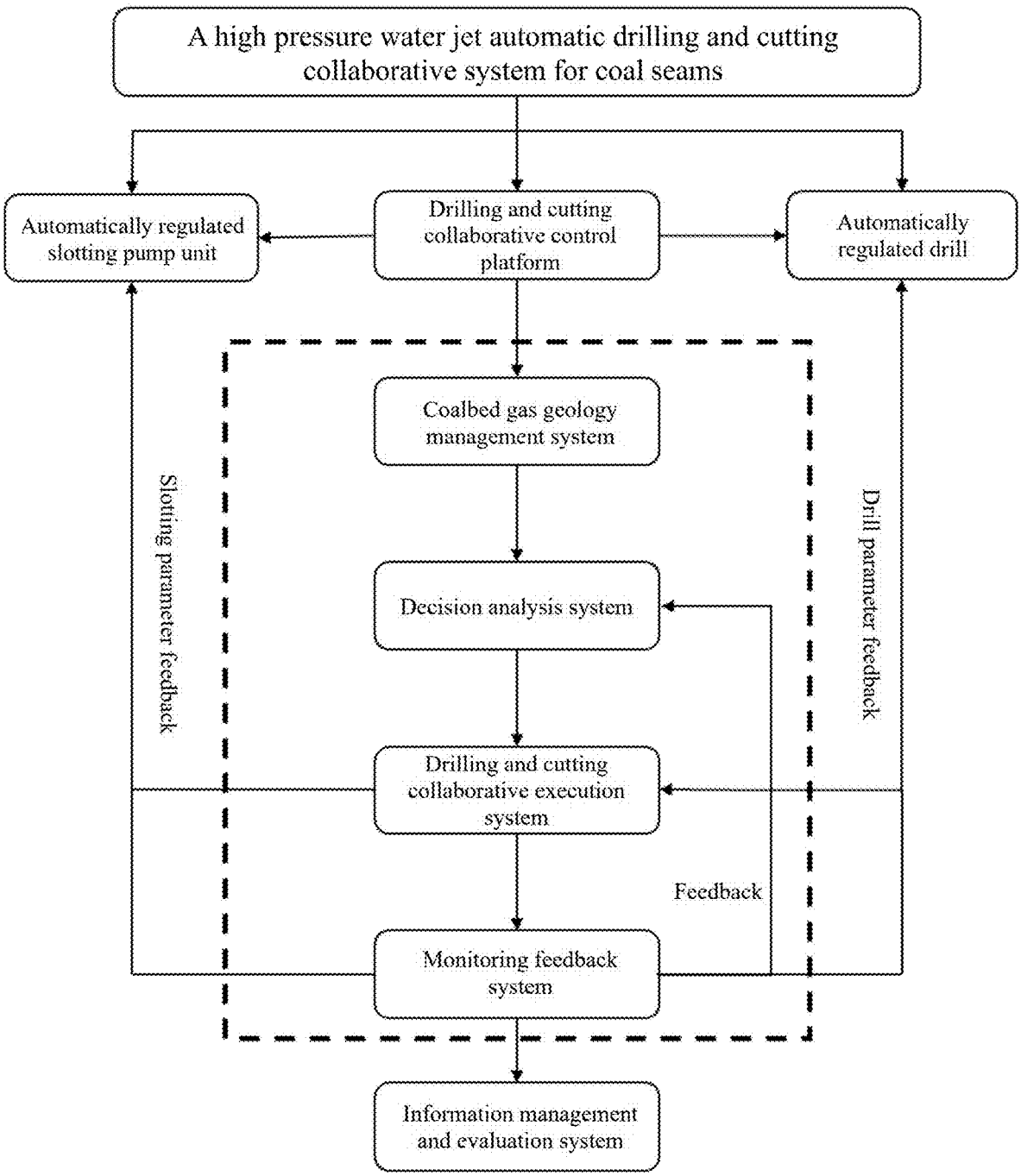
FIG. 1 is a schematic diagram of a system of the present invention.

Reference signs: drilling and cutting collaborative control platform 1; automatically regulated slotting pump unit 2; automatically regulated drill 3; roadway positioning sensor 4; pump unit positioning receiver 2-1; drill positioning receiver 3-1; coal seam 5; coal seam roof 6; coal seam floor 7; roadway 8; ring cutting and flat cutting cross borehole 9; ring cutting slot 9-1; flat cutting slot 9-2; flat cutting borehole 10; flat cutting construction borehole 11; wireless positioning slotting device 12.

DETAILED DESCRIPTION OF THE INVENTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

Wherein the drawings are only used for exemplary description, are only schematic diagrams rather than physical diagrams, and shall not be understood as a limitation to the present invention. In order to better illustrate the embodiments of the present invention, some components in the drawings may be omitted, scaled up or scaled down, and do not reflect actual product sizes. It should be understandable for those skilled in the art that some well-known structures and description thereof in the drawings may be omitted.

Same or similar reference numerals in the drawings of the embodiments of the present invention refer to same or similar components. It should be understood in the description of the present invention that terms such as "upper", "lower", "left", "right", "front" and "back" indicate direction or position relationships shown based on the drawings, and are only intended to facilitate the description of the present invention and the simplification of the description rather than to indicate or imply that the indicated device or element must have a specific direction or constructed and operated in a specific direction, and therefore, the terms describing position relationships in the drawings are only used for exemplary description and shall not be understood as a limitation to the present invention; for those ordinary skilled in the art, the meanings of the above terms may be understood according to specific conditions.

Figure 2:
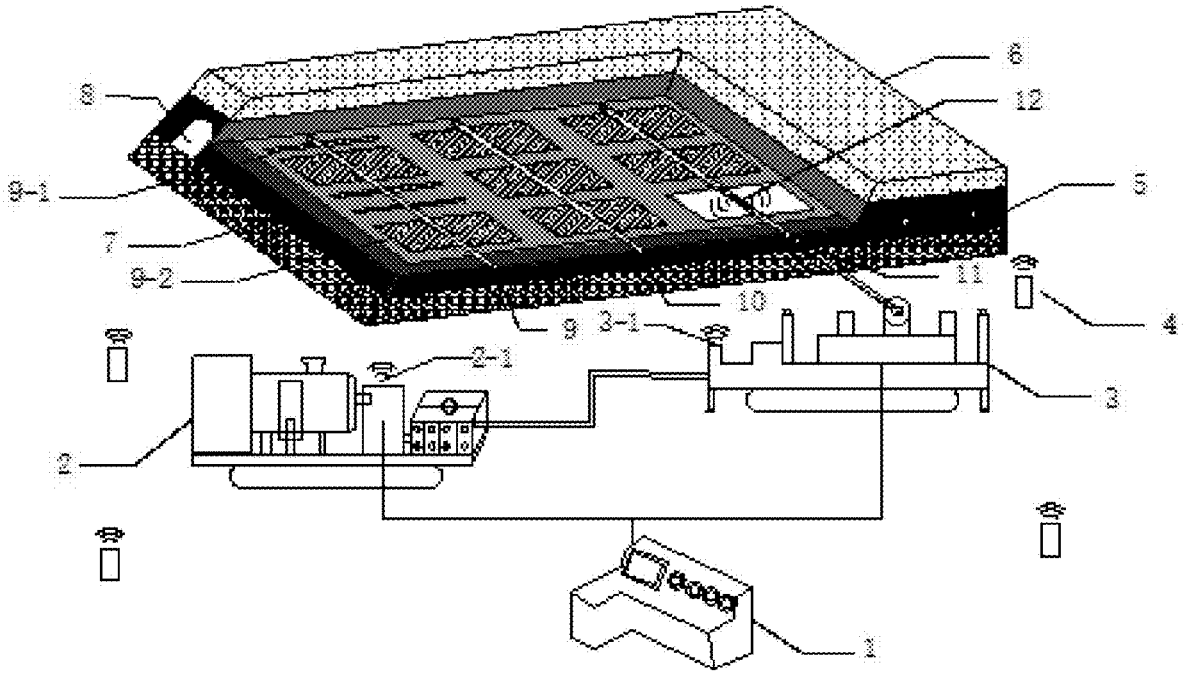
FIG. 2 is a composition diagram of a system of the present invention.

Referring to FIGS. 1-2, a high pressure water jet automatic drilling and cutting collaborative system for coal seams is disclosed, which can realize automated operation of borehole construction and borehole slotting, and overcome the problems such as relying on on-site operators. The system comprises a drilling and cutting collaborative control platform 1, an automatically regulated slotting pump unit 2 and an automatically regulated drill 3, wherein the drilling and cutting collaborative control platform is mainly used for realizing the functions of coalbed gas geology management, decision analysis, monitoring feedback, etc. and controlling the automatically regulated slotting pump unit 2 and the automatically regulated drill 3 to execute construction operation parameter commands. The automatically regulated slotting pump unit 2 is mainly used for executing slotting construction in boreholes, monitoring slotting parameters and correction, and ensuring the effect of coal seam slotting pressure relief and permeability improvement. The automatically regulated drill 3 is mainly used for realizing collaborative cooperation of independent drilling construction and slotting construction, and improving the construction efficiency.

During implementation, the working face of the coal seam 5 is 600 m long and 200 m wide, coal seam roof 6 and coal seam floor 7 are packsand, the roof and the floor are stable, the coal seam thickness is 5 m, the coal seam inclination angle is 2°, two small fault structures are found at a position of 300 m-400 m in a middle part of the coal seam, the coal body failure type is type II, the coal body firmness coefficient f is 0.5, the gas pressure is 0.9 MPa, and the gas content is 12 $m^3/t$;

The above coal seam geological information is entered into the coalbed gas geology management system for archiving and analysis, and the analysis is conducted by the decision analysis system based on the basic coal seam geological information entered and in combination with historical database basic information. The coal body firmness coefficient f of the coal seam is 0.5, the gas pressure is 0.9 MPa, the gas content is 12 $m^3/t$, and the outburst prevention measures is managed according to the prevention and control of outburst coal seams.

Further, the working face of the coal seam is 600 m long and 200 m wide, the coal seam roof 6 and the coal seam floor 7 are packsand, the roof and the floor are stable, two small fault structures are found at a position of 300 m-400 m in the middle part of the coal seam, the coal seam can be divided into three outburst prevention and extraction standard evaluation units, 0 m-200 m is a first unit, 200 m-400 m is a second unit, and 400 m-600 m is a third unit;

Further, the coal seam thickness is 5 m, the coal seam inclination angle is 2°, the coal body failure type is type II, it can be determined that the coal seam thickness is moderate and the integrity is good, and a single row of horizontal slotting boreholes can be constructed;

Further, it can be determined that the drilling spacing of the three units is 5 m, the drilling depth is 100 m, and the flat cutting process is the slotting process for the first unit and the third unit, the flat cutting process is the slotting process for the second unit, and the ring cutting and flat cutting process is the slotting process for the tectonic belt region.

Further, the construction operation command formulated by the decision analysis system is sent to the drilling and cutting collaborative execution system.

After the construction operation command is received by the drilling and cutting collaborative execution system, the automatically regulated slotting pump unit 2 and the control the automatically regulated drill 3 are controlled to start the borehole drilling and slotting construction operations;

Further, the construction boreholes are flat cutting boreholes 10 in the first and the third units, and are flat cutting boreholes 10 and ring cutting and flat cutting cross boreholes 9 in the second unit; the drilling spacing is 5 m, and the drilling depth is 100 m;

Further, taking the gas extraction boreholes of the second unit as an example, ring cutting and flat cutting cross boreholes 9 and flat cutting boreholes 10 are implemented, and implementation effect is briefed;

The high pressure water jet automatic drilling and cutting collaborative system for coal seams also comprises roadway positioning sensors 4 and a wireless positioning slotting device 12, and the roadway positioning sensors 4 are arranged within a certain range of a roadway construction site;

The automatically regulated slotting pump unit 2 is provided with a pump unit positioning receiver 2-1;

The automatically regulated drill 3 is provided with a drill positioning receiver 3-1;

The wireless positioning slotting device 12 is used for receiving a slotting positioning signal;

A certain distance is maintained among the roadway positioning sensors 4, the wireless positioning slotting device 12, the pump unit positioning receiver 2-1 and the drill positioning receiver 3-1, a signal is transmitted wirelessly to the automatic drilling and cutting collaborative system, and the system is automatically moved to a next construction site for construction according to a borehole construction spacing.

Further, a total of four the roadway positioning sensors 4 are arranged on both sides of a roadway 8 within 50 m of left and right sides of a roadway construction site, with two in front and two in back. Positioning signal connectivity of the pump unit positioning receiver 2-1 and the drill positioning receiver 3-1 is tested; A positioning distance between the automatically regulated slotting pump unit 2 and the rear sensors is 15 m, a positioning distance between the automatically regulated drill 3 and the front sensors is 15 m, a positioning distance between the automatically regulated slotting pump unit 2 and the automatically regulated drill 3 is 20 m, and a reasonable and safe construction operation distance is ensured;

Further, according to the construction parameters that the drilling spacing is 5 m and the drilling depth is 100 m, a rotational speed is set to be 80 r/min and an advance speed is set to be 3 min/m. The automatically regulated drill 3 is controlled by the drilling and cutting collaborative execution system to start a borehole drilling construction operation and construct the ring cutting and flat cutting cross boreholes 9 in a tectonic belt region of the second unit;

Further, the parameters of drill construction footage, drill pipe rotation speed and drill torque of the automatically regulated drill 3 are mainly monitored by the monitoring feedback system to transmit the data to the coalbed gas geology management system in real time and record the data;

Further, during drilling and cutting, when monitored parameters of the drill pipe rotational speed and the torque deviate from set parameters by 30%, the data is fed back to the decision analysis system and the drilling and cutting collaborative execution system to control the automatically regulated drill 3, the automatically regulated drill 3 is controlled to reduce the rotational speed by 50%, and the slotting pump unit 2 is controlled to reduce the slotting pressure to 0, so as to avoid phenomena of drill burying, drill sticking, etc.;

Further, during construction of the ring cutting and flat cutting cross boreholes 9, within 0-40 m and 60-80 m of the coal hole section, a drill pipe advance speed is normal and coal dust discharge is uniform, and it is monitored that the drill has a rotational speed of 80 r/min, an advance speed of 3 m/min, and a torque of 3000 N m. Within 40-60 m and 80-100 m, coal body is crushed, the drill has a rotational speed of 100 r/min, an advance speed of 3.5 m/min, and a torque of 2500 N m, which are within the ranges of construction parameters, and construction data is recorded and uploaded to the coalbed gas geology management system;

Further, the slotting construction operation command is formulated by the decision analysis system according to the borehole drilling construction parameter information uploaded to the coalbed gas geology management system. Starting from a bottom of a borehole, ring cutting slots 9-1 are constructed within 80-100 m and 40-60 m, and flat cutting slots 9-2 are constructed within 60-80 m and 20-40 m;

Further, the slotting radius is 1-1.5 m, and the slotting pressure is 80-100 MPa. During slotting construction, the ring cutting speed is set to be 60 r/min, the pressure is set to be 80-100 MPa, and the torque is set to be 5000 N m. During flat cutting, a drill pipe pullback speed is 10 min/m, and the pressure is 80-100 MPa.

Further, drill pipe withdrawal type slotting is adopted from the bottom of the borehole and is collaboratively controlled by the automatically regulated slotting pump unit 2 and the automatically regulated drill 3 according to the slotting parameters; the ring cutting slots 9-1 are constructed within 40-60 m and 80-100 m of the coal hole section for 7 cuttings, respectively, and the flat cutting slots 9-2 are constructed within 60-80 m and 20-40 m of the coal hole section for 4 cuttings, respectively;

Equipment operation parameters as well as drilling and cutting construction parameters of the automatically regulated slotting pump unit 2 and the automatically regulated drill 3 are monitored by the monitoring feedback system;

Further, main parameters such as the slotting pressure, the flow rate, slotting operation time, the oil temperature and the water level during the operation of the automatically regulated slotting pump unit 2, main parameters such as the drill pipe rotational speed and the drill torque of the automatically regulated drill 3, as well as the parameters such as the borehole slag discharge amount, the slag discharge slurry concentration and the gas concentration during borehole drilling and cutting construction are monitored by the monitoring feedback system;

Further, when slotting construction is executed, it is monitored that the slotting pressure is 80-100 MPa, the flow rate is 110-130 L/min, slotting time of a single cutting is 10-15 min, oil temperature of the automatically regulated slotting pump unit 2 is 40°-50°, and water level should ensure that more than ⅔ of construction operation parameters are within normal ranges.

Further, during slotting construction, it is mainly monitored that the drill pipe rotational speed of the automatically regulated drill 3 during ring cutting is 60 r/min, the drill torque is less than or equal to 5000 N m, and the drill pipe pullback speed during flat cutting is 10 min/m.

Further, it is monitored that a nozzle angle deviation of the flat cutting slots 9-2 during construction is ≤±10°, which is within a normal range of the deviation;

Further, it is monitored that during borehole construction, when the ring cutting slots 9-1 are constructed, if the borehole slag discharge amount is 0.8-1.0 t, the slag discharge slurry concentration is 20%-30%; if the borehole slag discharge amount is 1-1.5 t, the slag discharge slurry concentration is 30%-35%. During slotting implementation, it is monitored that emitted gas concentration within a construction range is ≤0.5%. according to the positions and number of the ring cutting slots 9-1 and the flat cutting slots 9-2 designed in the boreholes, drill pipe withdrawal is conducted successively to complete the slotting borehole construction.

After construction of the ring cutting and flat cutting cross boreholes 9 is completed, the automatically regulated slotting pump unit 2 and the automatically regulated drill 3 are controlled to move successively to the flat cutting boreholes 10 according to the roadway positioning sensors, spacing between the flat cutting slots is 5 m, slotting range of the coal hole section is 20-100 m, and slotting is conducted for 15 cuttings. The above steps are repeated to complete the flat cutting boreholes 10 and flat cutting construction boreholes 11. Similarly, flat cutting borehole construction in the first unit and the third unit is completed.

A scalar quantity of gas extraction in the borehole within one month after completion of borehole drilling and cutting construction in all units is counted, and effective extraction radius of boreholes, coal seam gas extraction rate and coal seam extraction standard evaluation are analyzed by the information management and evaluation system to evaluate gas control effect in the units.

Further, effective extraction radius of slotting boreholes shall be greater than ½ of the drilling spacing, otherwise it is determined that a gas extraction blank zone exists in the coal seam. In an extraction period, gas extraction concentration of a single construction shall not be less than 30%, otherwise it is determined that the borehole has a gas leakage and poor sealing, and the borehole shall be re-sealed. By measuring residual gas content of the coal seam and inputting the gas pressure into the information management and evaluation system to prevent sudden evaluation, the standard is stipulated to be that the residual gas content of the coal seams is 6 $m^3$/t and the gas pressure is below 0.6 MPa; if standard values are exceeded, extraction time shall be extended for half a month until measured values are below the standard values.

Further, according to statistics of extraction data of each slotting borehole for one month of continuous extraction, an average scalar quantity of gas extraction in a single hole is 0.8 $m^3$/min, and an average gas extraction concentration is 65%.

Further, it is analyzed by the information management and evaluation system that a total amount of coal seam gas in each unit is 3600000 $m^3$, a total amount of gas extracted by 40 slotting boreholes per unit in 30 days is 1382400 $m^3$, the coal seam gas extraction rate is 38.4%, and effective extraction radius of a single hole is 2.4 m; and it is measured that the coal seam has a residual gas content of 7.3 $m^3$/t and a gas pressure of 0.54 MPa. From the above, it can be determined that within 30 days of extraction, the slotting boreholes of the coal seam is sealed tightly and no gas leakage exists. However, the coal seam gas extraction is not supplemented, the effective extraction radius of boreholes shall be less than ½ of the drilling spacing, and a gas extraction blank zone exists in the coal seam. Although the coal seam residual gas pressure is reduced to 0.6 MPa, the coal seam gas extraction rate is low, and the coal seam residual gas content is greater than 6 $m^3$/t; therefore, it is preliminarily determined that the coal seam extraction in this area does not meet the standard, and the extraction time shall be extended for half a month until measured values are below the standard values.

Further, according to statistics of extraction data of each slotting borehole for 45 days of continuous extraction, an average scalar quantity of gas extraction in a single hole is 0.7 $m^3$/min, and an average gas extraction concentration is 55%. It is analyzed by the information management and evaluation system that a total amount of coal seam gas in each unit is 3600000 $m^3$, a total amount of gas extracted by 40 slotting boreholes per unit in 30 days is 1814400 $m^3$, the coal seam gas extraction rate is 50.4%, and effective extraction radius of a single hole is 2.9 m; and it is measured that the coal seam has a residual gas content of 5.9 $m^3$/t and a gas pressure of 0.45 MPa.

Further, it is determined by the information management and evaluation system that in this working face and within 45 days after the completion of the borehole construction, no extraction blank zone exists among the boreholes in the three units, borehole sealing quality is good, coal seam extraction rate is 50.4%, effective extraction radius of a single hole is 2.9 m, and the coal seam has a residual gas content of 5.9 $m^3$/t and a gas pressure of 0.45 MPa. It is comprehensively determined that the coal seam extraction of the working face meets the standard, the above results and data are uploaded to the drilling and cutting collaborative control platform for display, and the coal seam gas extraction is ended.

Figure 3A:
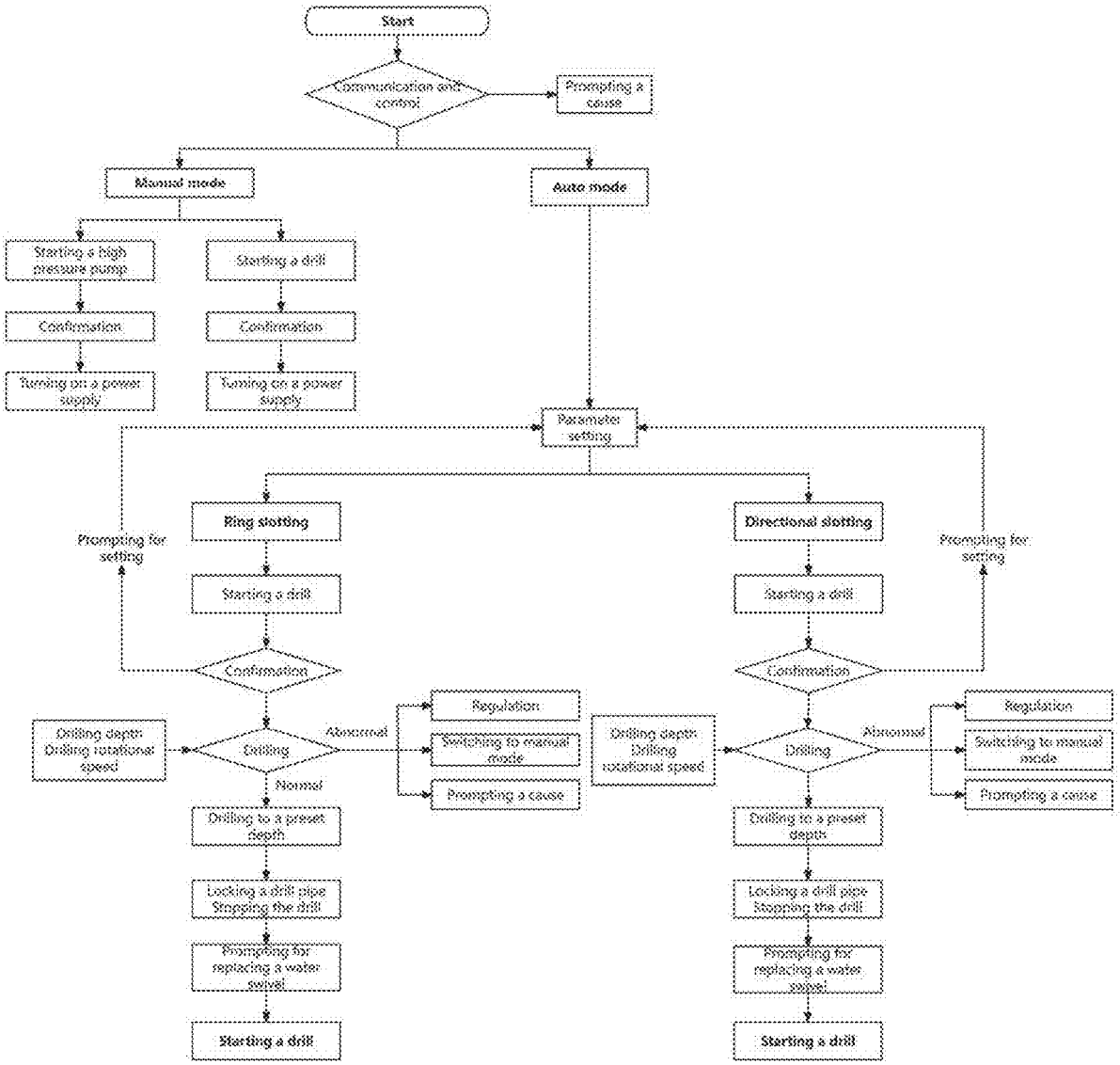
FIGS. 3A-3C are a flow chart of a method of the present invention.
Figure 3B:
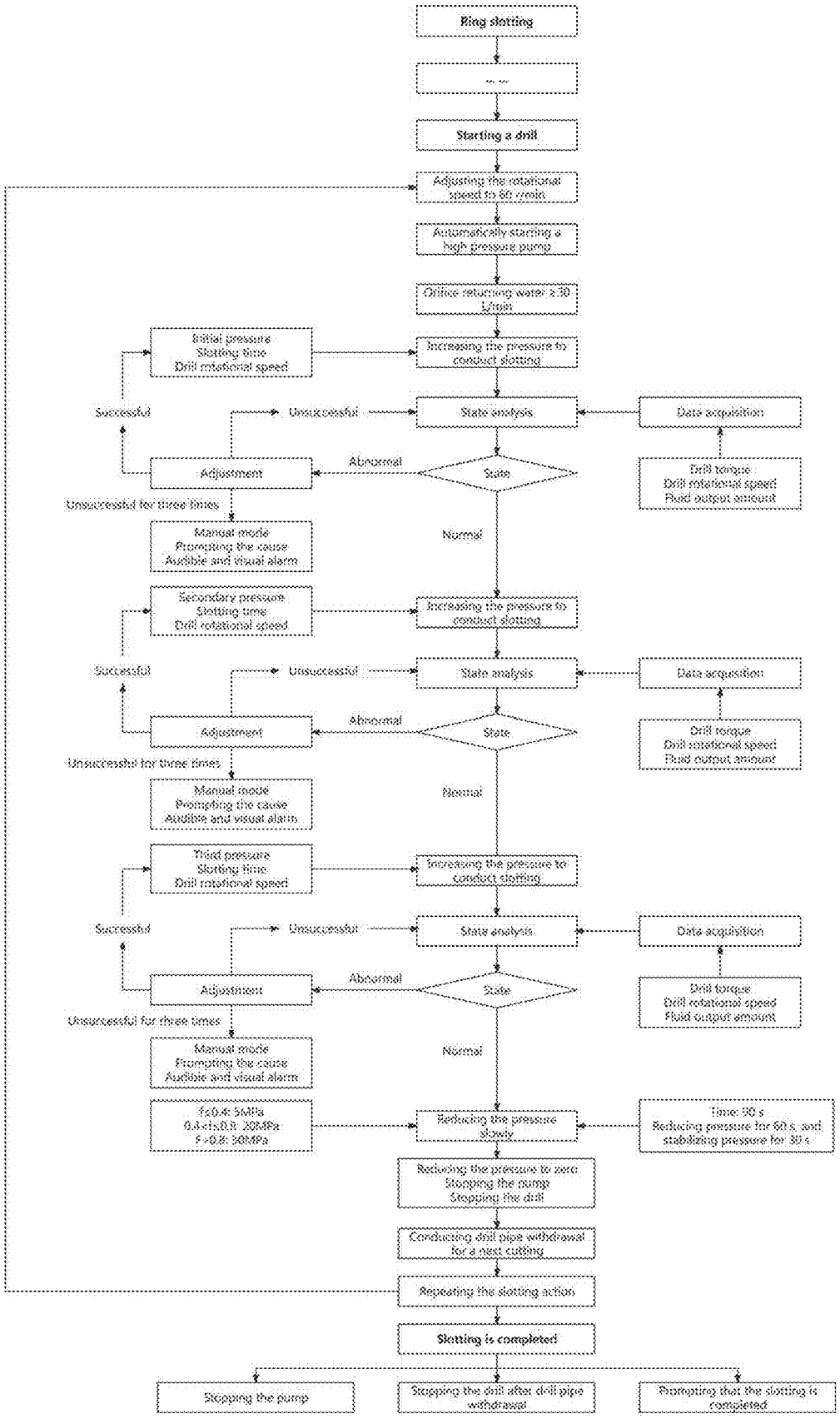
Figure 3C:
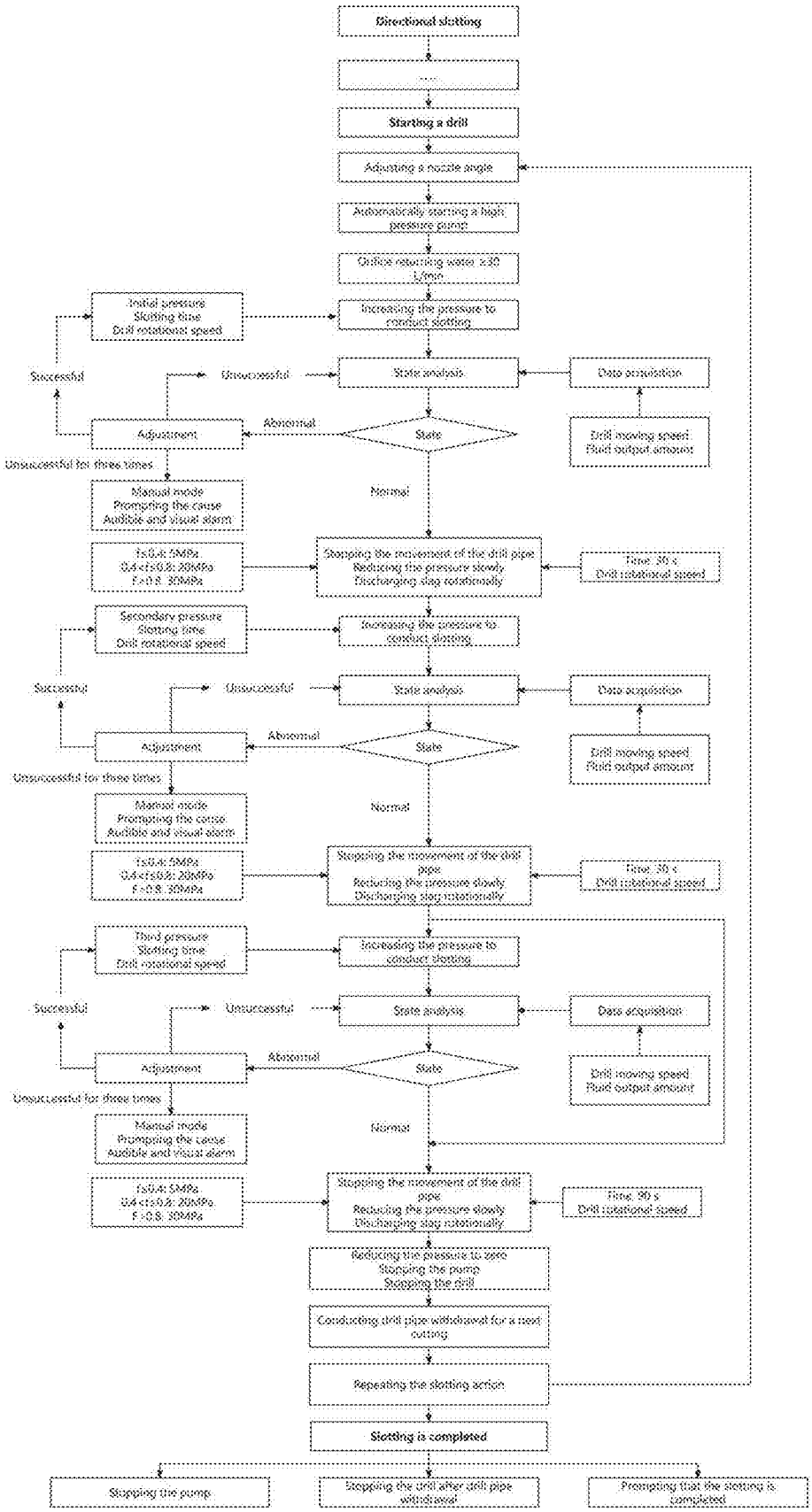
Figure 4:
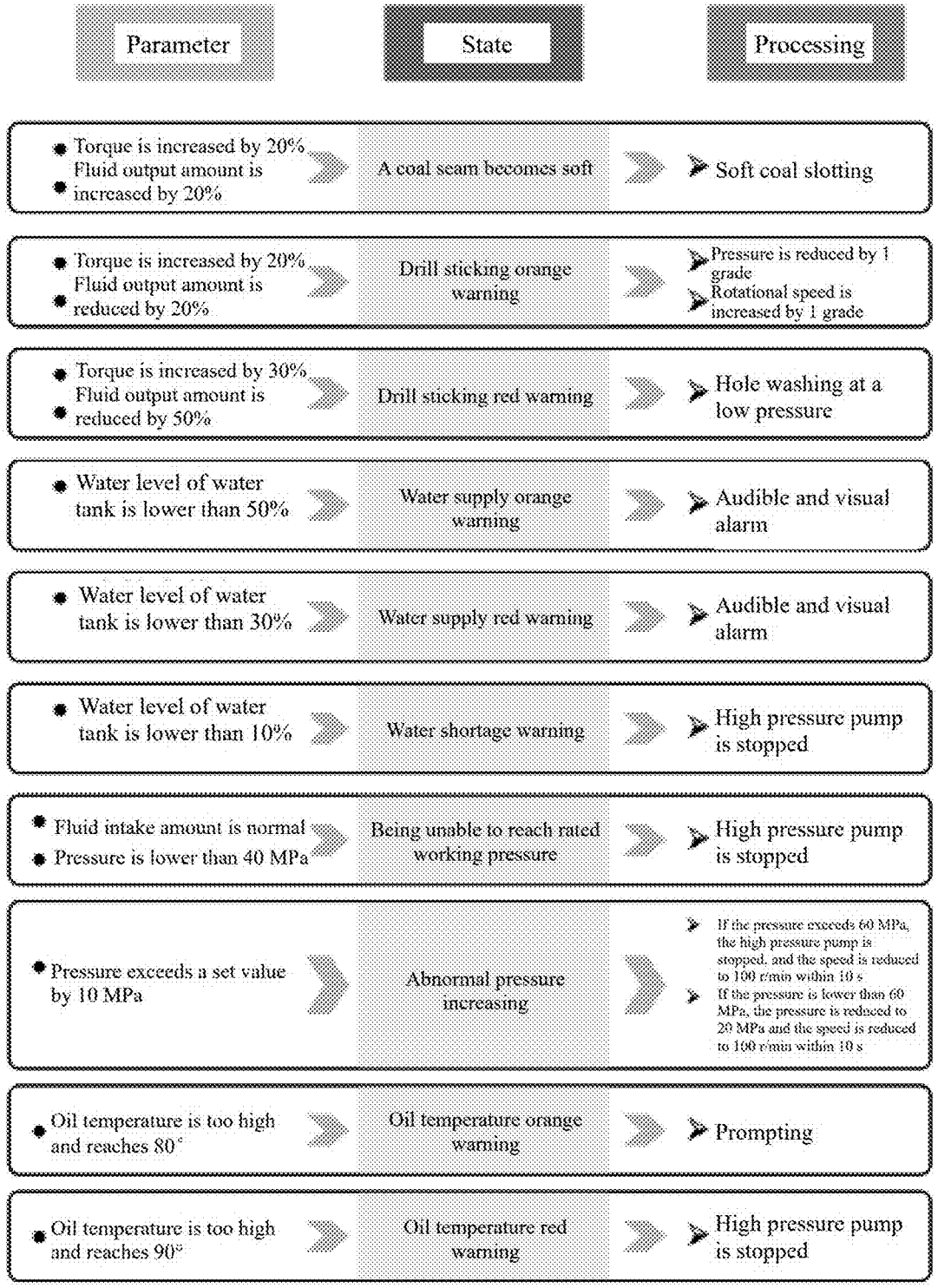
FIG. 4 is an audible and visual alarm processing flow chart of the present invention.

As shown in FIGS. 3A-3C which depict a flow chart of a method of the present invention, the method comprises a manual mode and an auto mode.

Manual mode: starting the slotting pump unit, and turning on a power supply after confirmation; starting the drill, and turning on the power supply after confirmation.

Auto Mode:

S1: Entering the coal seam geological information into the coalbed gas geology management system for archiving and analysis; judging whether ring slotting or directional slotting is required; if ring slotting is required, going to S11; if directional slotting is required, going to S14;

S11: Ring slotting;

S111: Starting the drill, and conducting confirmation; if confirmed, going to S113; if not confirmed, return to S1;

S113: Conducting drilling according to the drilling depth and drill rotational speed input; when an exception occurs, conducting regulation, or switching to the manual mode; or prompting a fault cause. if normal, going to S114;

S114: When the drill drills to a preset depth, locking the drill pipe, stopping the drill, prompting for replacing a water swivel, and starting the drill again;

S115: Adjusting the rotational speed to 60 r/min;

S116: Automatically starting a high pressure pump;

S117: Orifice returning water ≥30 L/min;

S118: Increasing the pressure to conduct slotting;

S119: Collecting data of drill torque, drill rotational speed and fluid output amount to conduct state analysis;

S120: Judging whether the state is normal; if normal, going to S121; if abnormal, going to S1201;

S1201: Conducting adjustment; if the adjustment is unsuccessful, returning to S119; if the adjustment is unsuccessful for three times, entering the manual mode, prompting the cause, and providing an audible and visual alarm; if the adjustment is successful, performing S118 according to initial pressure, slotting time and drill rotational speed;

S121: Increasing the pressure to conduct slotting;

S122: Collecting data of drill torque, drill rotational speed and fluid output amount to conduct state analysis;

S123: Judging whether the state is normal; if normal, going to S124; if abnormal, going to S1221;

S124: Increasing the pressure to conduct slotting;

S1221: Conducting adjustment; if the adjustment is unsuccessful, returning to S122; if the adjustment is unsuccessful for three times, entering the manual mode, prompting the cause, and providing an audible and visual alarm; if the adjustment is successful, performing S121 according to secondary pressure, slotting time and drill rotational speed;

S125: Collecting data of drill torque, drill rotational speed and fluid output amount to conduct state analysis;

S126: Judging whether the state is normal; if normal, going to S127; if abnormal, going to S1261;

S1261: Conducting parameter adjustment; if the adjustment is unsuccessful, going to S125; if the adjustment is successful, performing S124 according to third pressure, slotting time and drill rotational speed; if the adjustment is unsuccessful for three times, entering the manual mode, prompting the cause, and providing an audible and visual alarm;

S127: Reducing the pressure slowly;

S128: Reducing the pressure to zero; stopping the pump; stopping the drill;

S129: Conducting drill pipe withdrawal for a next cutting;

S130: Repeating the slotting action; if the slotting is not completed, returning to S115; if the slotting is completed, going to S131;

S131: Stopping the pump, stopping the drill after drill pipe withdrawal, and prompting that the slotting is completed.

S14: Directional slotting;

S141: Starting the drill;

S142: Confirming whether the drill is started; if started, going to S143; if not started, returning to S1;

S143: Conducting drilling according to the drilling depth and drill rotational speed input; when an exception occurs, conducting regulation, or switching to the manual mode; or prompting a fault cause. if normal, going to S144;

S144: When the drill drills to a preset depth, locking the drill pipe, stopping the drill, prompting to replace a water swivel, and starting the drill again;

S145: Adjusting a nozzle angle;

S146: Automatically starting a high pressure pump;

S147: Orifice returning water ≥30 L/min;

S148: Increasing the pressure to conduct slotting;

S149: Collecting data of drill torque, drill rotational speed and fluid output amount to conduct state analysis;

S150: Judging whether the state is normal; if normal, going to S151; if abnormal, going to S1501;

S1501: Conducting adjustment; if the adjustment is unsuccessful, returning to S149; if the adjustment is unsuccessful for three times, entering the manual mode, prompting the cause, and providing an audible and visual alarm; if the adjustment is successful, performing S148 according to initial pressure, slotting time and drill moving speed;

S151: Stopping the movement of the drill pipe, performing a hole washing procedure, reducing the pressure slowly, and discharging slag rotationally; duration of the drill rotational speed is 90 s, pressure reducing time is 30 s; pressure stabilizing time is 60 s, when $f \leq 0.4$, the pressure is 5 MPa; when $0.4 < f \leq 0.8$, the pressure is 20 MPa; when $f > 0.8$, the pressure is 30 MPa;

S152: Increasing the pressure to conduct slotting;

S153: Collecting data of the drill moving speed and fluid output amount to conduct state analysis;

S154: Judging whether the state is normal; if normal, going to S155; if abnormal, going to S1541;

S1541: Conducting adjustment; if the adjustment is unsuccessful, returning to S153; if the adjustment is unsuccessful for three times, entering the manual mode, prompting the cause, and providing an audible and visual alarm; if the adjustment is successful, performing S152 according to secondary pressure, slotting time and drill moving speed;

S155: Stopping the movement of the drill pipe, performing a hole washing procedure, reducing the pressure slowly, and discharging slag rotationally; duration of the drill rotational speed is 90 s, pressure reducing time is 30 s; pressure stabilizing time is 60 s, when $f \leq 0.4$, the pressure is 5 MPa; when $0.4 < f \leq 0.8$, the pressure is 20 MPa; when $f > 0.8$, the pressure is 30 MPa;

S156: Increasing the pressure to conduct slotting;

S157: Collecting data of the drill moving speed and fluid output amount to conduct state analysis;

S158: Judging whether the state is normal; if normal, going to S159; if abnormal, going to S1581;

S1581: Conducting parameter adjustment; if the adjustment is unsuccessful, going to S157; if the adjustment is successful, performing S124 according to third pressure, slotting time and drill moving speed; if the adjustment is unsuccessful for three times, entering the manual mode, prompting the cause, and providing an audible and visual alarm;

S159: Stopping the movement of the drill pipe, performing a hole washing procedure, reducing the pressure slowly, and discharging slag rotationally; duration of the drill rotational speed is 90 s, pressure reducing time is 30 s; pressure stabilizing time is 60 s, when $f \leq 0.4$, the pressure is 5 MPa; when $0.4 < f \leq 0.8$, the pressure is 20 MPa; when $f > 0.8$, the pressure is 30 MPa;

S160: Reducing the pressure to zero; stopping the pump; stopping the drill;

S161: Conducting drill pipe withdrawal for a next cutting;

S162: Repeating the slotting action; if the slotting is not completed, returning to S145; if the slotting is completed, going to S163;

S163: Stopping the pump, stopping the drill after drill pipe withdrawal, and prompting that the slotting is completed.

When the parameters are that the torque is increased by 20% and the fluid output amount is increased by 20%, the coal seam becomes soft, and soft coal slotting is conducted.

When the parameters are that the torque is increased by 20% and the fluid output amount is increased by 20%, a drill sticking orange warning state is presented, and the pressure is reduced by 1 grade and the rotational speed is increased by 1 grade.

When the parameters are that the torque is increased by 30% and the fluid output amount is increased by 50%, a drill sticking red warning state is presented, and hole washing at a low pressure is conducted.

When the parameter is that water level of a water tank is lower than 50%, a water supply orange warning state is presented, and an audible and visual alarm is provided.

When the parameter is that water level of a water tank is lower than 30%, a water supply red warning state is presented, and an audible and visual alarm is provided.

When the parameter is that water level of a water tank is lower than 10%, a water shortage warning state is presented, and the high pressure pump is stopped.

When the parameters are that a fluid intake amount is normal and the pressure is lower than 40 MPa, a state of being unable to reach rated working pressure is presented, and the high pressure pump is stopped.

When the parameter is that the oil temperature is too high and reaches 80°, an oil temperature orange warning state is presented, and a promotion is provided.

When the parameter is that the oil temperature is too high and reaches 90°, an oil temperature red warning state is presented, and the high pressure pump is stopped.

Table 1 is a basis for judging drilling and cutting parameters.

TABLE 1

| f value | Crushing degree | Initial pressure | Pressurization gradient | Holding time | Highest pressure | Drill rotational speed | Slag discharge time | Slotting time |
|---|---|---|---|---|---|---|---|---|
| 1.0 | I | 0 | 60-20-20 | 180 s | 100 | 0 (30 s) + 50 | 60 s | 10 min |
| | II | 0 | 60-20-20 | 180 s | 100 | 0 (30 s) + 50 | 60 s | 10 min |
| | III | — | — | — | — | — | — | — |
| | IV | — | — | — | — | — | — | — |
| 0.8 | I | 0 | 60-20-20 | 180 s | 100 | 0 (30 s) + 50 | 60 s | 10 min |
| | II | 0 | 60-20-20 | 180 s | 100 | 0 (30 s) + 50 | 60 s | 10 min |
| | III | — | — | — | — | — | — | — |
| | IV | — | — | — | — | — | — | — |
| 0.7 | I | 0 | 40-20-20 . . . | 120 s | 100 | 60 | 60 s | 9 min |
| | II | 0 | 40-20-20 . . . | 120 s | 100 | 60 | 60 s | 9 min |
| | III | 0 | 20-20-20 . . . | 120 s | 100 | 60 | 90 s | 11.5 min |
| | IV | — | — | — | — | — | — | — |
| 0.6 | I | 0 | 20-20-20 . . . | 120 s | 100 | 60 | 90 s | 11.5 min |
| | II | 0 | 20-20-20 . . . | 120 s | 100 | 60 | 90 s | 11.5 min |
| | III | 0 | 20-20-20 . . . | 120 s | 100 | 60 | 90 s | 11.5 min |
| | IV | — | — | — | — | — | — | — |
| 0.5 | I | 0 | 15-15 . . . 10 | 120 s | 100 | 60 | 90 s | 15.5 min |
| | II | 0 | 15-15 . . . 10 | 120 s | 100 | 60 | 90 s | 15.5 min |
| | III | 0 | 15-15 . . . 10 | 120 s | 100 | 60 | 90 s | 15.5 min |
| | IV | — | — | — | — | — | — | — |
| 0.4 | I | 0 | 15-15 . . . 10 | 120 s | 100 | 60 | 90 s | 15.5 min |
| | II | 0 | 15-15 . . . 10 | 120 s | 100 | 60 | 120 s | 16 min |
| | III | 0 | 15-15 . . . 10 | 120 s | 100 | 60 | 120 s | 16 min |
| | IV | — | — | — | — | — | — | — |
| 0.3 | I | — | — | — | — | — | — | — |
| | II | 0 | 10-10-10 . . . | 180 s | 60 | 80 | 180 s | 21 min |

TABLE 1-continued

| | | | | | | | | | |
|---|---|---|---|---|---|---|---|---|---|
| | III | 0 | 10-10-10 . . . | 180 s | 60 | 80 | 180 s | 21 min |
| | IV | 0 | 10-10-10 . . . | 180 s | 60 | 80 | 180 s | 21 min |
| 0.2 | I | — | — | — | — | — | — | — |
| | II | — | — | — | — | — | — | — |
| | III | 0 | 10-10-10 . . . | 180 s | 60 | 80 | 180 s | 21 min |
| | IV | 0 | 10-10-10 . . . | 180 s | 60 | 80 | 180 s | 21 min |

| F value | Crushing degree | Initial pressure | Pressurization gradient | Holding time | Slag discharge time | Highest pressure | Drill rotational speed | Average speed | Slotting time |
|---|---|---|---|---|---|---|---|---|---|
| 1.0 | I | 0 | 60-20-20 . . . | 300 s | 30 s | 100 | 60 | 0.2 m/min | 16.5 min |
| | II | 0 | 60-20-20 . . . | 300 s | 30 s | 100 | 60 | 0.2 m/min | 16.5 min |
| | III | — | — | — | — | — | — | — | — |
| | IV | — | — | — | — | — | — | — | — |
| 0.8 | I | 0 | 60-20-20 . . . | 200 s | 30 s | 100 | 60 | 0.3 m/min | 11.5 min |
| | II | 0 | 60-20-20 . . . | 200 s | 30 s | 100 | 60 | 0.3 m/min | 11.5 min |
| | III | — | — | — | — | — | — | — | — |
| | IV | — | — | — | — | — | — | — | — |
| 0.7 | I | 0 | 40-20-20 . . . | 150 s | 30 s | 100 | 60 | 0.4 m/min | 12 min |
| | II | 0 | 40-20-20 . . . | 150 s | 30 s | 100 | 60 | 0.4 m/min | 12 min |
| | III | — | — | — | — | — | — | — | — |
| | IV | — | — | — | — | — | — | — | — |
| 0.6 | I | 0 | 20-20-20 . . . | 120 s | 30 s | 100 | 60 | 0.5 m/min | 12.5 min |
| | II | 0 | 20-20-20 . . . | 120 s | 30 s | 100 | 60 | 0.5 m/min | 12.5 min |
| | III | — | — | — | — | — | — | — | — |
| | IV | — | — | — | — | — | — | — | — |
| 0.5 | I | 0 | 15-15-15 . . . | 120 s | 30 s | 90 | 60 | 0.5 m/min | 15 min |
| | II | 0 | 15-15-15 . . . | 120 s | 30 s | 90 | 60 | 0.5 m/min | 15 min |
| | III | — | — | — | — | — | — | — | — |
| | IV | — | — | — | — | — | — | — | — |
| 0.4 | I | 0 | 10-10-10 . . . | 100 s | 30 s | 90 | 60 | 0.6 m/min | 19.5 min |
| | II | 0 | 10-10-10 . . . | 100 s | 40 s | 90 | 60 | 0.6 m/min | 21 min |
| | III | 0 | 10-10-10 . . . | 100 s | 40 s | 90 | 60 | 0.6 m/min | 21 min |
| | I | — | — | — | — | — | — | — | — |

Finally, it should be noted that the above embodiments are only used for describing, rather than limiting the technical solution of the present invention. Although the present invention is described in detail with reference to the preferred embodiments, those ordinary skilled in the art shall understand that the technical solution of the present invention can be amended or equivalently replaced without departing from the purpose and the scope of the technical solution. The amendment or equivalent replacement shall be covered within the scope of the claims of the present invention.

The invention claimed is:

1. A high pressure water jet automatic drilling and cutting collaborative system for coal seams, characterized in that: the system comprises a drilling and cutting collaborative control platform (1), an automatically regulated slotting pump unit (2) and an automatically regulated drill (3);

the drilling and cutting collaborative control platform (1) comprises a coalbed gas geology management system, a decision analysis system, a drilling and cutting collaborative execution system, a monitoring and feedback system, and an information management and evaluation system;

construction operation parameter instructions issued by the drilling and cutting collaborative control platform are executed by the automatically regulated slotting pump unit and the automatically regulated drill;

coal seam geological information is recorded by the coalbed gas geology management system, and coal seam type and outburst prevention measures are analyzed and judged by the decision analysis system based on the coal seam geological information;

a construction operation command is sent to the drilling and cutting collaborative execution system by the decision analysis system to control the automatically regulated drill (3) to start drilling and control the automatically regulated slotting pump unit (2) to start slotting; drilling and cutting construction parameters of drilling spacing, drilling depth, slotting process and slotting radius are analyzed and determined by the decision analysis system based on coal seam basic parameter information provided by the coalbed gas geology management system;

the drilling and cutting collaborative execution system is monitored by the monitoring feedback system to control operation parameter instructions and device performance indexes during drilling and slotting construction executed by the automatically regulated drill (3) and the automatically regulated slotting pump unit (2);

slotting parameter feedback is sent to the automatically regulated slotting pump unit, drill parameter feedback is sent to the automatically regulated drill and the drilling and cutting collaborative execution system, and drilling and slotting parameter feedback is sent to the decision analysis system by the monitoring feedback system; timely adjustment is made by the decision analysis system according to construction data to readjust and formulate slotting parameters and send a slotting construction operation command;

monitored parameters of drilling and slotting are also sent to the information management and evaluation system by the monitoring feedback system;

the high pressure water jet automatic drilling and cutting collaborative system for coal seams also comprises roadway positioning sensors (4) and a wireless positioning slotting device (12), and the roadway positioning sensors (4) are arranged within a certain range of a roadway construction site;

the automatically regulated slotting pump unit (2) is provided with a pump unit positioning receiver (2-1);

the automatically regulated drill (3) is provided with a drill positioning receiver (3-1);

the wireless positioning slotting device (12) is used for receiving a slotting positioning signal and monitor a slotting positioning angle of construction in boreholes; a certain distance is maintained among the roadway positioning sensors (4), the pump unit positioning receiver (2-1) and the drill positioning receiver (3-1), a signal is transmitted wirelessly to the automatic drilling and cutting collaborative system, and the system is automatically moved to a next construction site for construction according to a borehole construction spacing;

a scalar quantity of gas extraction in the borehole within one month after completion of borehole drilling and cutting construction in all units is counted, and effective extraction radius of boreholes, coal seam gas extraction rate and coal seam extraction standard evaluation are analyzed by the information management and evaluation system to evaluate gas control effect in the units.

2. The high pressure water jet automatic drilling and cutting collaborative system for coal seams as claimed in claim 1, characterized in that: the parameters of slotting process and slotting radius are determined by the decision analysis system according to the coal seam thickness, the coal body failure type, the coal body firmness coefficient, and coal rock condition while drilling;

when the coal body failure type is Type IV, ring cutting process is selected as the slotting process;

when the coal body failure type is Type I, II, III or coal seam tectonic region, flat cutting process is selected as the slotting process;

when the coal seam thickness is 0-3 m, the slotting radius is 1 m;

when the coal seam thickness is 3-6 m, the slotting radius is 2 m;

when the coal seam thickness is >6 m, the slotting radius is 2 m, and double rows of slotting boreholes are arranged;

when the coal body firmness coefficient is $f \leq 0.5$, the slotting radius is 2.5 m;

when the coal body firmness coefficient is $0.5 \leq f \leq 1$, the slotting radius is 2 m;

when the coal body firmness coefficient is $f > 1$, the slotting radius is 1 m;

the ring cutting process is selected as the slotting process in a crushing area of a coal hole section, and the flat cutting process is selected as the slotting process in a complete area of the coal hole section.

3. The high pressure water jet automatic drilling and cutting collaborative system for coal seams as claimed in claim 1, characterized in that: the coal seam geological information includes width of a working face of a coal seam, stratum type of coal seam roof, stratum type of coal seam floor, roof and floor stability, coal seam thickness, coal seam inclination angle, fault structure position in the coal seam, coal body failure type, coal body firmness coefficient, gas pressure and gas content.

4. The high pressure water jet automatic drilling and cutting collaborative system for coal seams as claimed in claim 3, characterized in that: if it is analyzed by the decision analysis system that the fault structure position in the coal seam is Z, an area within 100 m of the fault structure position Z is defined as one outburst prevention and extraction standard evaluation unit.

5. The high pressure water jet automatic drilling and cutting collaborative system for coal seams as claimed in claim 3, characterized in that: when the working face of the coal seam is 600 m long and 200 m wide, the stratum type of coal seam roof and the stratum type of coal seam floor are packsand, the roof and floor stability is stable, the coal seam thickness is 5 m, the coal seam inclination angle is 2°, the fault structure position in the coal seam is that a fault structure is found at a position of 300 m, the coal body failure type is type II, the coal body firmness coefficient f is 0.5, the gas pressure is 0.9 MPa, and the gas content is 12 $m^3/t$, the coal seam is divided into three outburst prevention and extraction standard evaluation units, 0 m-200 m is a first unit, 200 m-400 m is a second unit, and 400 m-600 m is a third unit;

flat cutting boreholes (10) are implemented in the first and the third units, and ring cutting and flat cutting cross boreholes (9) and flat cutting boreholes (10) are implemented in the second unit for gas extraction boreholes;

according to the construction parameters that the drilling spacing is 5 m and the drilling depth is 100 m, a rotational speed is set to be 80 r/min and an advance speed is set to be 3 min/m.

6. The high pressure water jet automatic drilling and cutting collaborative system for coal seams as claimed in claim 5, characterized in that: the automatically regulated drill (3) is controlled by the drilling and cutting collaborative execution system to start a borehole drilling construction operation and construct the ring cutting and flat cutting cross boreholes (9) in a tectonic belt region of the second unit;

the data of drill construction footage, drill pipe rotational speed and drill torque of the automatically regulated drill (3) is monitored by the monitoring feedback system to transmit the data to the coalbed gas geology management system in real time and record the data;

during construction of the ring cutting and flat cutting cross boreholes (9), within 0-40 m and 60-80 m of the coal hole section, a drill pipe advance speed is normal and coal dust discharge is uniform, and it is monitored that the drill has a rotational speed of 80 r/min, an advance speed of 3 m/min, and a torque of 3000 N·m; within 40-60 m and 80-100 m, coal body is crushed, the drill has a rotational speed of 100 r/min, an advance speed of 3.5 m/min, and a torque of 2500 N·m, which are within the ranges of construction parameters, and construction data is recorded and uploaded to the coalbed gas geology management system;

slotting parameters are formulated and a slotting construction operation command is sent by the decision analysis system; starting from a bottom of a borehole, ring cutting slots (9-1) are constructed within 80-100 m and 40-60 m, and flat cutting slots (9-2) are constructed within 60-80 m and 20-40 m;

the slotting radius is 1-1.5 m, and the slotting pressure is 80-100 MPa; during slotting construction, the ring cutting speed is set to be 60 r/min, the pressure is set to be 80-100 MPa, and the torque is set to be 5000 N·m; during flat cutting, a drill pipe pullback speed is 10 min/m, and the pressure is 80-100 MPa;

in the ring cutting and flat cutting cross boreholes (9) or the flat cutting boreholes (10), a spacing between the ring cutting slots (9-1) is 2-3 times the slotting radius, a spacing between the flat cutting slots (9-2) is 3-5 times the slotting depth, and a spacing between the ring cutting slots and the flat cutting slots is 3 times the slotting depth;

drill pipe withdrawal type slotting is adopted from the bottom of the borehole and is collaboratively controlled by the automatically regulated slotting pump unit (2) and the automatically regulated drill (3) according to the slotting parameters; the ring cutting slots (9-1) are constructed within 40-60 m and 80-100 m of the coal hole section for 7 cuttings, respectively, and the flat cutting slots (9-2) are constructed within 60-80 m and 20-40 m of the coal hole section for 4 cuttings, respectively;

when slotting construction is executed, it is monitored that the slotting pressure is 80-100 MPa, the flow rate is 110-130 L/min, slotting time of a single cutting is 10-15 min, oil temperature of the automatically regulated slotting pump unit (2) is 40°-50° and water level should ensure that more than ⅔ of construction operation parameters are within normal ranges;

during slotting construction, it is monitored that the drill pipe rotational speed of the automatically regulated drill (3) during ring cutting is 60 r/min, the drill torque is less than or equal to 5000 N·m, and the drill pipe pullback speed during flat cutting is 10 min/m;

it is monitored that a nozzle angle deviation of the flat cutting slots (9-2) during construction is ≤+10°, which is within a normal range of the deviation;

after construction of the ring cutting and flat cutting cross boreholes (9) is completed, the automatically regulated slotting pump unit (2) and the automatically regulated drill (3) are controlled to move successively to the flat cutting boreholes (10) according to the roadway positioning sensors, spacing between the flat cutting slots is 5 m, slotting range of the coal hole section is 20-100 m, and slotting is conducted for 15 cuttings; the above steps are repeated to complete the flat cutting boreholes (10) and flat cutting construction boreholes (11); similarly, flat cutting borehole construction in the first unit and the third unit is completed.

7. The high pressure water jet automatic drilling and cutting collaborative system for coal seams as claimed in claim 6, characterized in that: equipment operation parameters as well as drilling and cutting construction parameters of the automatically regulated slotting pump unit (2) and the automatically regulated drill (3) are monitored by the monitoring feedback system;

the parameters specifically include drill construction footage, drill pipe rotational speed and drill torque, and data of the parameters are transmitted to the coalbed gas geology management system in real time; different drill pipe rotational speeds are set for borehole construction or ring cutting construction according to coal seams of different geological conditions; during drilling and cutting, when monitored parameters of the drill pipe rotational speed and the torque deviate from set parameters by 30%, the data is fed back to the decision analysis system and the drilling and cutting collaborative execution system to control the automatically regulated drill, the automatically regulated drill (3) is controlled to reduce the rotational speed by 50%, and the slotting pump unit is controlled to reduce the slotting pressure to 0;

when flat cutting slots are constructed for a borehole, a slotting angle is monitored by the wireless positioning slotting device; when an angular deviation is ±15°, the slotting angle is corrected to 0°;

parameters of borehole slag discharge amount, slag discharge slurry concentration and gas concentration during drilling and cutting construction are monitored, and critical parameters of the slag discharge amount are given according to coal seams of different geological conditions; when it is monitored that the borehole slag discharge amount is greater than 10% of a set critical value, the automatically regulated drill (3) is controlled to reduce the rotational speed by 50%, and the automatically regulated slotting pump unit (2) is controlled to reduce the slotting pressure to 50 MPa; when the slag discharge slurry concentration is greater than 50% during slotting, the automatically regulated slotting pump unit (2) is stopped, and drill pipe withdrawal is conducted by the automatically regulated drill (3) to move to a next slotting position;

it is monitored that during borehole construction, when the ring cutting slots (9-1) are constructed, if the borehole slag discharge amount is 0.8-1.0 t, the slag discharge slurry concentration is 20%-30%; if the borehole slag discharge amount is 1-1.5 t, the slag discharge slurry concentration is 30%-35%; during slotting implementation, it is monitored that emitted gas concentration within a construction range is ≤0.5%; according to the positions and number of the ring cutting slots (9-1) and the flat cutting slots (9-2) designed in the boreholes, drill pipe withdrawal is conducted successively to complete the slotting borehole construction.

8. The high pressure water jet automatic drilling and cutting collaborative system for coal seams as claimed in claim 7, characterized in that: the effective extraction radius of boreholes is greater than ½ of the drilling spacing, otherwise it is determined that a gas extraction blank zone exists in the coal seam;

in an extraction period, gas extraction concentration of a single gas extraction borehole is not less than 30%, otherwise it is determined that the borehole has a gas leakage and poor sealing, and the borehole needs to be re-sealed; by measuring residual gas content of the coal seam and inputting the gas pressure into the information management and evaluation system to prevent sudden evaluation, the standard is stipulated to be that the residual gas content of the coal seam is 6 $m^3$/t and the gas pressure is below 0.6 MPa; if standard values are exceeded, extraction time is extended for half a month until measured values are below the standard values.

9. A high pressure water jet automatic drilling and cutting collaborative method for coal seams, characterized in that: the method comprises the following steps:

executing construction operation parameter instructions issued by the drilling and cutting collaborative control platform by the automatically regulated slotting pump unit and the automatically regulated drill;

recording coal seam geological information by the coalbed gas geology management system, and analyzing and judging coal seam type and outburst prevention measures by the decision analysis system based on the coal seam geological information;

sending a construction operation command to the drilling and cutting collaborative execution system by the decision analysis system to control the automatically regulated drill (3) to start drilling and control the automatically regulated slotting pump unit (2) to start slotting; analyzing and determining reasonable drilling and cutting construction parameters of drilling spacing, drilling depth, slotting process and slotting radius by the decision analysis system based on coal seam basic parameter information provided by the coalbed gas geology management system;

sending drilling and slotting operation parameter instructions to the monitoring feedback system by the drilling and cutting collaborative execution system;

sending monitored parameters of drilling and slotting to the information management and evaluation system by the monitoring feedback system;

sending slotting parameter feedback to the automatically regulated slotting pump unit, sending drill parameter feedback to the automatically regulated drill and the drilling and cutting collaborative execution system, and sending drilling and slotting parameter feedback to the decision analysis system by the monitoring feedback system;

the high pressure water jet automatic drilling and cutting collaborative system for coal seams also comprises roadway positioning sensors (4) and a wireless positioning slotting device (12), and the roadway positioning sensors (4) are arranged within a certain range of a roadway construction site;

the automatically regulated slotting pump unit (2) is provided with a pump unit positioning receiver (2-1);

the automatically regulated drill (3) is provided with a drill positioning receiver (3-1);

the wireless positioning slotting device (12) is used for receiving a slotting positioning signal;

a certain distance is maintained among the roadway positioning sensors (4), the wireless positioning slotting device (12), the pump unit positioning receiver (2-1) and the drill positioning receiver (3-1), a signal is transmitted wirelessly to the automatic drilling and cutting collaborative system, and the system is automatically moved to a next construction site for construction according to a borehole construction spacing;

the slotting pressure, the flow rate, slotting operation time, the oil temperature and the water level during the operation of the automatically regulated slotting pump unit (2), the drill pipe rotational speed and the drill torque of the automatically regulated drill (3), as well as the borehole slag discharge amount, the slag discharge slurry concentration and the gas concentration during borehole drilling and cutting construction are monitored by the monitoring feedback system;

after borehole construction of the second unit is completed, the automatically regulated slotting pump unit and the automatically regulated drill are controlled to move successively to a next borehole according to the roadway positioning sensors, and the above steps are repeated to successively complete drilling in the first unit and the third unit.

10. The high pressure water jet automatic drilling and cutting collaborative method for coal seams as claimed in claim 9, characterized in that: a scalar quantity of gas extraction in the borehole within one month after completion of borehole drilling and cutting construction in all units is counted, and effective extraction radius of boreholes, coal seam gas extraction rate and coal seam extraction standard evaluation are analyzed by the information management and evaluation system to evaluate gas control effect in the units;

effective extraction radius of slotting boreholes is greater than ½ of the drilling spacing, otherwise it is determined that a gas extraction blank zone exists in the coal seam; in an extraction period, gas extraction concentration of a single construction shall not be less than 30%, otherwise it is determined that the borehole has a gas leakage and poor sealing, and the borehole is re-sealed; by measuring residual gas content of the coal seam and inputting the gas pressure into the information management and evaluation system to prevent sudden evaluation, the standard is stipulated to be that the residual gas content of the coal seam is 6 $m^3/t$ and the gas pressure is below 0.6 MPa; if standard values are exceeded, extraction time is extended for half a month until measured values are below the standard values.

* * * * *